US009528802B1

(12) United States Patent
Markowitch et al.

(10) Patent No.: US 9,528,802 B1
(45) Date of Patent: Dec. 27, 2016

(54) INDIRECT FIRE MUNITION NON-LETHAL CARGO CARRIER MORTAR

(71) Applicants: Michael Markowitch, Rockaway, NJ (US); Francesco Rizzi, Hopatcong, NJ (US); Bryan Drake, Great Meadows, NJ (US); Jason Surmanek, Franklin Lakes, NJ (US); Samuel Perez, Hackettstown, NJ (US); Raymond Trohanowsky, Franklin, NJ (US); Wooje Na, Ridgefield, NJ (US); Piotr Czerechowski, Rockaway, NJ (US)

(72) Inventors: Michael Markowitch, Rockaway, NJ (US); Francesco Rizzi, Hopatcong, NJ (US); Bryan Drake, Great Meadows, NJ (US); Jason Surmanek, Franklin Lakes, NJ (US); Samuel Perez, Hackettstown, NJ (US); Raymond Trohanowsky, Franklin, NJ (US); Wooje Na, Ridgefield, NJ (US); Piotr Czerechowski, Rockaway, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/946,118

(22) Filed: Nov. 19, 2015

(51) Int. Cl.
*F42B 10/56* (2006.01)
*F42B 12/36* (2006.01)
*F42B 30/10* (2006.01)

(52) U.S. Cl.
CPC ..... *F42B 12/36* (2013.01); *F42B 10/56* (2013.01); *F42B 30/10* (2013.01)

(58) Field of Classification Search
CPC ..... F42B 4/028; F42B 8/20; F42B 8/22; F42B 8/12; F42B 10/32; F42B 10/48; F42B 10/52; F42B 12/58; F42B 12/625; F42B 25/00; F42B 30/10; F42B 30/12
USPC ..... 102/387, 340, 348, 339, 354, 337, 489, 102/393, 445
See application file for complete search history.

(56) References Cited

U.S. PATENT DOCUMENTS 1,442,929 A * 1/1923 Elia ..... F42B 10/56 102/337
1,937,191 A * 11/1933 Driggs, Jr. ..... F42B 4/28 102/338
2,110,061 A * 3/1938 Gentzel ..... F42B 4/26 102/257
2,124,876 A * 7/1938 Driggs, Jr. ..... F42B 4/28 102/339
2,271,224 A * 1/1942 Goddard ..... B64D 17/52 102/387
2,360,912 A * 10/1944 Unterberg ..... F42B 10/56 102/504
3,038,407 A * 6/1962 Robertson ..... F42B 10/56 102/340

(Continued)

*Primary Examiner* — Bret Hayes
*Assistant Examiner* — Derrick Morgan
(74) *Attorney, Agent, or Firm* — John P. DiScala

(57) ABSTRACT

An indirect fire munition non-lethal cargo carrier mortar deploys non-lethal sub-munitions to an intended target. The cargo carrier mortar includes a deceleration system which allows for the discarded mortar to descend at a controlled non-free fall velocity thereby minimizing the risk of injury or collateral damage from the mortar. The cargo carrier mortar is adapted to be compatible with existing standard military equipment such as standard mortar caliber sizes.

16 Claims, 7 Drawing Sheets

(56) References Cited

U.S. PATENT DOCUMENTS 3,054,584 A * 9/1962 Andras ..... B64G 9/00 102/387
3,092,027 A * 6/1963 Price ..... F41F 3/052 102/377
3,092,358 A * 6/1963 Potts, Jr. ..... B64D 17/383 102/354
3,101,213 A * 8/1963 Elsner ..... B64D 17/383 102/387
3,104,612 A * 9/1963 Knacke ..... F41J 9/08 102/357
3,112,906 A * 12/1963 Zeyher ..... B64D 1/14 102/387
3,221,656 A * 12/1965 Sutten ..... F42B 8/24 102/348
3,351,010 A * 11/1967 Ainslie ..... F41H 11/14 102/387
3,374,739 A * 3/1968 Rodger ..... F42B 8/24 102/501
3,557,697 A * 1/1971 Joyner ..... F42B 12/14 102/383
3,715,668 A * 2/1973 Herring ..... H01Q 1/08 102/339
3,730,099 A * 5/1973 Schopp ..... F42B 10/56 102/339
3,752,077 A * 8/1973 Roberts ..... F42B 4/28 102/337
3,818,833 A * 6/1974 Throner, Jr. ..... F42B 10/56 102/213
3,948,175 A * 4/1976 Bucklisch ..... F42B 12/58 102/383
4,013,009 A * 3/1977 Claude ..... F42B 10/56 102/339
4,023,495 A * 5/1977 Fischer ..... F42B 10/54 102/334
4,215,836 A * 8/1980 Zacharin ..... B64D 19/00 102/354
4,226,185 A * 10/1980 Tobler ..... F42B 10/56 102/340
4,333,400 A * 6/1982 McNelia ..... F42C 21/00 102/348
4,372,215 A * 2/1983 Crepin ..... B64D 1/04 102/387
4,651,648 A * 3/1987 Alon ..... F42B 10/56 102/334
4,777,879 A * 10/1988 Bueno ..... F42C 15/184 102/226
4,926,751 A * 5/1990 Wittman ..... F42B 12/62 102/348
5,054,397 A * 10/1991 Hans ..... F42B 10/56 102/337
H001150 H * 3/1993 Fritch ..... F42B 8/12 102/293
5,239,927 A * 8/1993 Frye ..... F42B 10/56 102/340
5,370,057 A * 12/1994 Badura ..... F42B 12/625 102/354
5,386,781 A * 2/1995 Day ..... F42B 4/28 102/337
5,409,187 A * 4/1995 Dunham ..... B63C 9/26 102/340
5,467,681 A * 11/1995 Liberman ..... F42B 10/56 244/3.1
H001534 H * 6/1996 Fritch ..... F42B 10/56 102/354
5,661,257 A * 8/1997 Nielson ..... F42B 12/70 102/334
5,760,330 A * 6/1998 Himmert ..... F42B 12/62 102/337
6,144,899 A * 11/2000 Babb ..... B64C 13/18 102/384
6,212,718 B1 * 4/2001 Stolpmann ..... A61G 7/05776 285/914
6,230,629 B1 * 5/2001 Doctor ..... F42B 4/28 102/337
6,782,829 B1 * 8/2004 Han ..... F42B 10/56 102/387
7,036,773 B2 * 5/2006 Caldwell ..... B64G 1/002 244/137.4
7,124,690 B1 * 10/2006 Tadros ..... F42B 12/48 102/334
7,360,489 B1 * 4/2008 Han ..... F42B 10/56 102/444
8,263,919 B2 * 9/2012 Murphy ..... F42B 12/365 244/147
2003/0197095 A1 * 10/2003 Preston ..... B64D 1/14 244/152
2006/0049316 A1 * 3/2006 Antonenko ..... B64G 1/002 244/171.3
2007/0267547 A1 * 11/2007 Hennings ..... B64D 17/343 244/145
2008/0289530 A1 * 11/2008 Adorjan ..... A63H 27/005 102/348
2009/0007812 A1 * 1/2009 Zahn ..... F42B 4/28 102/340
2009/0151590 A1 * 6/2009 Dau ..... F42B 4/28 102/342
2015/0284080 A1 * 10/2015 Facciano ..... B64D 1/14 244/3.24
2016/0209189 A1 * 7/2016 Adams ..... F42B 12/42

* cited by examiner

INDIRECT FIRE MUNITION NON-LETHAL CARGO CARRIER MORTAR

FEDERAL RESEARCH STATEMENT

The invention described herein may be manufactured, used, and licensed by or for the U.S. Government for U.S. Government purposes.

BACKGROUND OF INVENTION

Field of the Invention

The present invention relates to non-lethal weapons, and more particularly to non-lethal cargo projectiles.

Related Art

In today's combat environment, soldiers are increasingly fighting in urban environments where enemy combatants may be mixed in within a civilian population. Non-lethal weapons are an effective tool where traditional munitions may not be used. In particular, non-lethal weapons allow for the suppression of targets and the ability to return fire in situations where the use of high explosives (HE) or other lethal force is not allowed.

Indirect fire, such as mortar fire, is an effective way to deploy non-lethal weapons to an area. However, there are downsides to such an approach when using conventional cargo carrier mortars. The body which houses the non-lethal ordinance, as well as the tail section if the indirect fire vehicle is a mortar, can cause serious damage in itself when descending to the ground after deployment.

To reduce the likelihood of damage from deployed shells, attempts have been made in the past to decelerate the shell. However, such attempts have been ineffective, compromised payload or were incompatible with present military standards.

Accordingly, there is a need for an indirect fire munition that provides today's warfighter the capability to return fire under restrictive rules of engagement (ROE) while minimizing civilian casualties and limiting collateral damage.

SUMMARY OF INVENTION

The present invention relates to an indirect fire munition non-lethal cargo carrier mortar for deploying non-lethal sub-munitions. The cargo carrier mortar includes a deceleration system which allows for the discarded mortar to descend at a controlled non-free fall velocity thereby minimizing the risk of injury or collateral damage from the mortar. The cargo carrier mortar is adapted to be compatible with existing standard military equipment such as standard mortar caliber sizes.

According to a first aspect of the invention, a non-lethal cargo carrier mortar is configured for delivering a non-lethal payload and descending at a non-free fall velocity. The non-lethal cargo carrier mortar includes a first parachute assembly, a second parachute assembly and a recess. The first parachute assembly further comprises a first tether coupling a first parachute to a front portion of the non-lethal cargo carrier mortar. The second parachute assembly comprises a second tether coupling a second parachute to a rear portion of the non-lethal cargo carrier mortar. The recess is formed within the front portion of the non-lethal cargo carrier mortar and is configured for supporting the first tether on an outer surface and further configured for shielding the tether from gases ejected from a supplemental charge ignited by a fuze.

According to a second aspect of the invention, an 81 millimeter caliber non-lethal cargo carrier mortar configured for dispersing a non-lethal payload and descending at a non-free fall velocity, the non-lethal cargo carrier mortar includes an M776 fuze, a fuze adapter, a body, a tail cone, a fin, a first parachute assembly, a second parachute assembly and a drogue parachute assembly. The M776 fuze is configured for detonating a supplemental charge at a predetermined time. The fuze adapter is configured for supporting the M776 fuze and further includes a recess formed within an outer surface of the fuze adapter. The recess is configured for supporting a first tether coiled on an outer surface of the recess and for shielding the first tether by channeling propulsive gases released from the supplemental charge through an inner surface of the recess. The body comprises a payload area formed in a cavity of the body and one or more shear pins configured for shearing in response to pressure from the propulsive gases. The first parachute assembly comprises the first tether coupling a first parachute disposed in the payload area of the body to the fuze adapter. The second parachute assembly comprises a second tether coupling a second parachute disposed in the payload area of the body to the tail cone. A drogue parachute assembly comprises a drogue parachute and a parachute bag configured for housing the first parachute and second parachute until deployment.

BRIEF DESCRIPTION OF THE DRAWINGS

The accompanying figures further illustrate the present invention.

The components in the drawings are not necessarily drawn to scale, emphasis instead being placed upon clearly illustrating the principles of the present invention. In the drawings, like reference numerals designate corresponding parts throughout the several views.

DETAILED DESCRIPTION

The present invention relates to an indirect fire munition non-lethal cargo carrier mortar for deploying non-lethal sub-munitions. The cargo carrier mortar minimizes risk of injury or collateral damage while allowing for the suppression of targets and the ability to return fire when the use of high explosive (HE) or lethal force is not authorized. The cargo carrier mortar comprises a payload area 13 for housing non-lethal sub-munitions and is configured for dispersing the non-lethal sub-munitions over an area. To further reduce the risk of injury or damage, the cargo carrier mortar further comprises a deceleration system for returning the cargo carrier mortar to the ground at a reduced velocity. Advantageously, the cargo carrier mortar minimizes the weight and size of deceleration system, thereby maximizing the payload. Further, the cargo carrier mortar meets current military specifications and may be used with existing weapon propulsion systems.

Figure 1:
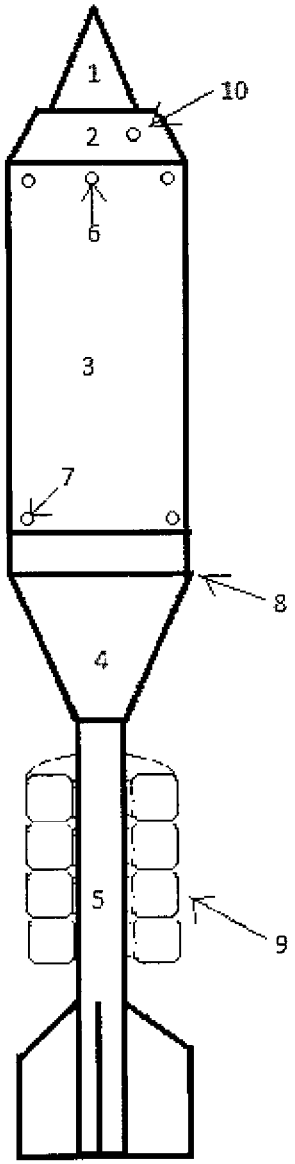
FIG. 1 is a diagram illustrating the components of a non-lethal cargo carrier mortar, in accordance with an illustrative embodiment of the invention.

FIG. 1 is a diagram illustrating a non-lethal cargo carrier mortar, in accordance with an illustrative embodiment of the invention. The non-lethal cargo carrier mortar comprises a fuze 1, a fuze adapter 2, a body 3, a tail cone 4, a fin assembly 5, retaining pins 6, shear pins 7, an obturator ring 8, and fuze adapter pins 10. The cargo carrier mortar may also comprise one or more propelling charges 9 secured around the fin assembly 5.

Figure 2:
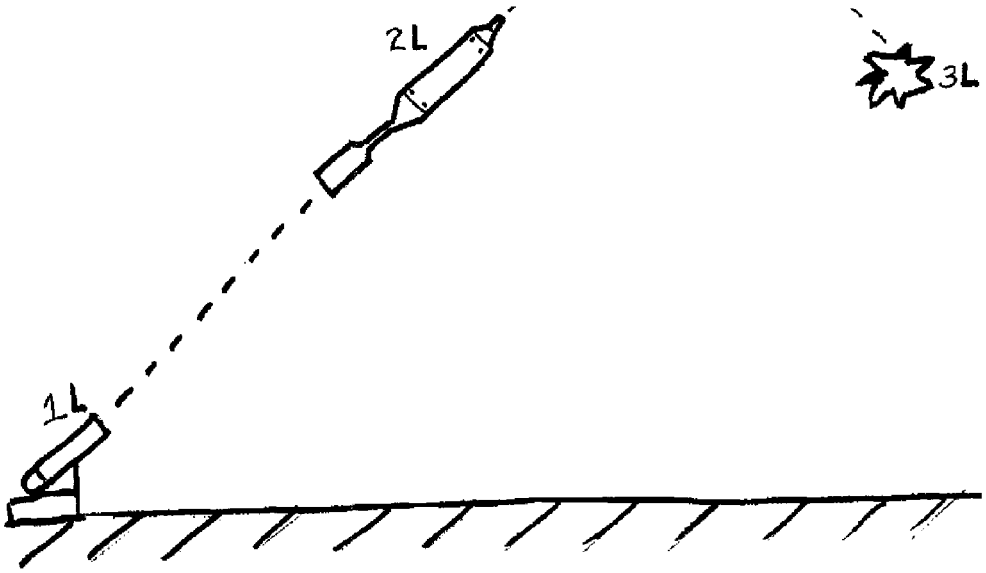
FIG. 2 illustrates the various stages in the firing of a non-lethal cargo carrier mortar, in accordance with an illustrative embodiment of the invention.

FIG. 2 illustrates the various stages in the firing of a non-lethal cargo carrier mortar, in accordance with an illustrative embodiment of the invention. The non-lethal cargo carrier mortar is fired from an indirect firing system such as an M252 81 millimeter (mm) caliber mortar system. A primer disposed in the fin assembly 5 of the cargo carrier mortar is ignited by a firing pin in the canon tube of the mortar system. The primer subsequently ignites an ignition cartridge, also disposed in the fin assembly 5 of the cargo carrier mortar, which provides a propulsive force to the cargo carrier mortar. One or more propulsive charges secured around the fin assembly 5 of the cargo carrier mortar may be ignited by the ignition charge through holes in the fin assembly 5 to provide additional propulsive force for reaching further zones of fire.

At a predetermined time after propulsion, as determined by ballistic calculations to ensure a desired range and height, the fuze 1 of the cargo carrier mortar detonates a supplemental charge in a fuze adapter. For example, the fuze 1 may be set to detonate a supplemental charge at a height of 175 meters. The supplemental charge pressurizes the internal cavity of the non-lethal cargo carrier mortar and causes the internal contents of the cargo carrier mortar to be pushed toward the tail cone 4. When the force on the tail cone 4 reaches a certain threshold, the shear pins 7 fail thereby allowing the tail cone 4 to separate from the body 3. As this happens, split sleeves and a rear plate fall away and the non-lethal payload and deceleration system begin exiting through the opening of the body 3.

As the internal contents of the cargo carrier mortar exit from the force of the supplemental charge, the non-lethal sub-munitions are deployed and the deceleration system is engaged. The deceleration system slows the descent of a forward portion of the cargo carrier mortar and a rear portion of the cargo carrier mortar to a reduced speed from free fall velocity.

Figure 3:
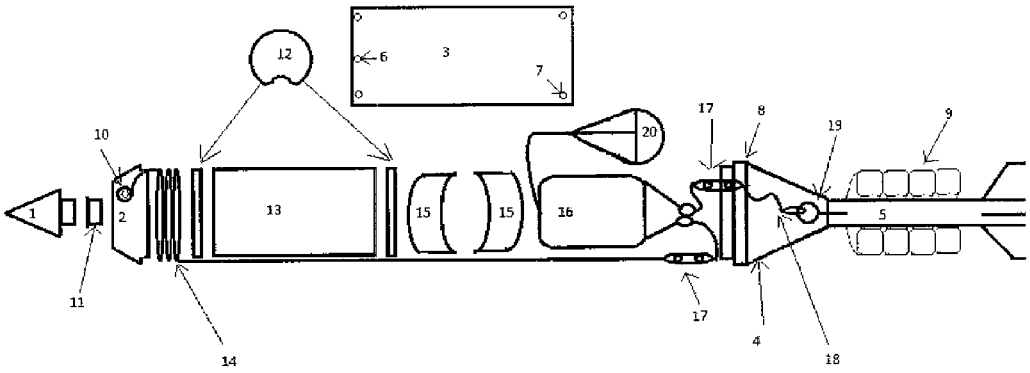
FIG. 3 is an exploded diagram illustrating the components of a non-lethal cargo carrier mortar, in accordance with an illustrative embodiment of the invention.

FIG. 3 is an exploded diagram illustrating the components of a non-lethal cargo carrier mortar, in accordance with an illustrative embodiment of the invention. The fuze 1 is disposed in the front of the cargo carrier mortar and is configured for igniting a supplemental charge 11 at a predetermined time in the flight of the cargo carrier mortar. The fuze 1 may be a mechanical time super quick (MTSQ) M776 fuze currently employed by the United States Army. The fuze 1 is configured for igniting the supplemental charge 11 at a predetermined time or altitude in the mortar's flight based on ballistic equations to achieve a payload distance.

The fuze 1 and supplemental charge 11 are set in a fuze adapter 2. In addition to supporting the fuze 1 and supplemental charge 11, the fuze adapter 2 is configured for funneling the propulsive gases of the supplemental charge 11 toward the rear of the cargo carrier mortar and supporting a first tether 14 of a first parachute assembly, as will be described in further detail below. The fuze adapter 2 is connected to the body 3 of the cargo carrier mortar.

The body 3 of the cargo carrier mortar forms an inner cavity housing a first plate 12, a second plate 12, a payload area 13, a first split sleeve 15 and a second split sleeve 15. The first plate 12 is configured for receiving the pressure built up from the fuze and supplemental charge and transferring it to the sub-munitions. The second plate 12 sits under the sub-munitions and receives the force from the front plate 12 and transfers the force to the front split sleeve 15 and second split sleeve 15. The front split sleeve 15 and the second split sleeve 15 surround the parachute assembly and transfer the force from the first plate 12 and second plate 12 to the tail cone thereby causing the shear pins to fail and the mortar carrier to separate.

One or more non-lethal sub-munitions are housed in the payload area 13. Advantageously, the payload area 13 provides an increased volume and payload potential due to the deceleration design reducing both the weight and volume of the deceleration system. In an embodiment of the invention, the payload area 13 houses fourteen (14) flash bang sub-munitions. While throughout this specification, the payload is described as one or more flash bang sub-munitions, the cargo carrier mortar is not limited to housing flash bang sub-munitions. The payload area 13 may house any non-lethal cargo including cargo that can be ignited by the flash from a fuze. For example, the payload area may contain stink bombs, marking dye and whistles.

The first split sleeve 15 and second split sleeve 15 are configured for protecting the parachute while also transferring force directly to the tail cone.

The first parachute assembly, second parachute assembly and drogue parachute assembly comprising a parachute bag comprise the deceleration system of the cargo carrier mortar. The front parachute assembly is configured for slowing the descent of the front portion of the cargo carrier mortar to a velocity lower than free fall velocity. The second parachute assembly is configured for slowing the descent of the rear portion of the cargo carrier mortar to a velocity lower than free fall velocity. The parachute bag houses a first parachute 21 of the first parachute assembly and a second parachute 22 of the second parachute assembly prior to deployment.

The first parachute assembly comprises a first parachute 21 connected to the front portion of the cargo carrier mortar via a first swivel 17 and a first tether 14. In an embodiment of the invention, the first parachute 21 is a parachute of a size and dimension typically used for an 81 mm illumination mortar, such as an M853A1 81 mm illumination round currently in use by branches of the United States military. The first parachute 21 is connected to the first swivel 17 which is connected to the first tether 14. The first tether 14 attaches to the fuze adapter 2 via a first fuze adapter pin 10. In an embodiment of the invention, the fuze adapter further comprises a steel alloy pin extending from a surface of the fuze adapter and the first tether is looped around the steel alloy pin.

Prior to deployment, the first tether 14 is wrapped around a recessed surface of the fuze adapter 2. The recess surface shields the tether from propulsive gases travelling from the fuze 1 of the cargo carrier mortar toward the body 3 of the cargo carrier mortar. Further, coiling the tether within the recess surface of the fuze adapter prevents tangling of the tether and non-deployment of the first parachute 21.

The second parachute assembly comprises a second parachute 22 connected to the rear portion of the cargo carrier mortar via a second swivel 17 and a second tether 18. The second parachute 22 is connected to the second swivel 17 which is connected to the second tether 18. In an embodiment of the invention, the second parachute 22 is a parachute of a size and dimension typically used for a sixty mm illumination mortar. The second parachute 22 is connected to the second swivel 17 which is connected to the second tether 18. The second tether 18 attaches to the fin via an eyebolt threaded to the fin.

To ensure the proper strength of the tethers, the first tether and the second tether may be formed from a material comprising Kevlar fibers, Technora fibers or steel. In an embodiment of the invention, the first tether and the second tether are wrapped in a low friction tape configured for preventing abrasion The cargo carrier mortar further comprises a drogue parachute 20 and a parachute bag 16. The parachute bag 16 holds both the first parachute 21 of the first parachute assembly and the second parachute 22 of the second parachute assembly prior to deployment. The parachute bag 16 is tethered to the drogue parachute 20.

Figure 4:
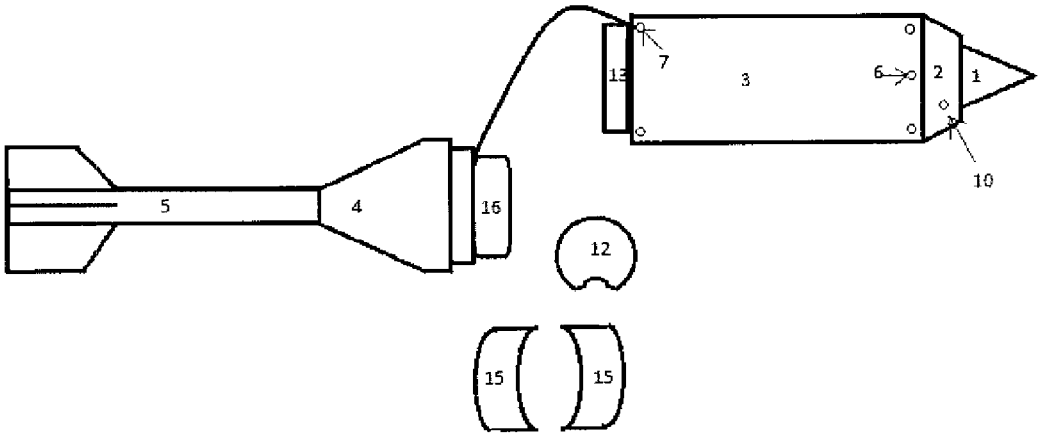
FIG. 4 is a diagram illustrating a non-lethal cargo carrier mortar at separation, in accordance with an illustrative embodiment of the present invention.

FIG. 4 is a diagram illustrating a non-lethal cargo carrier mortar at separation, in accordance with an illustrative embodiment of the present invention. At fuze detonation, the fuze 1 detonates a supplemental charge 11 causing the front of the round to pressurize. If required, the supplemental charge 11 may also ignite the payload. The pressure from the supplemental charge 11 provides a force on the contents within the body 3 toward the rear of the cargo carrier mortar. Once enough force is applied to the tail cone 4, the shear pins 7 fail which allows the rear portion of the cargo carrier mortar, specifically the tail, to separate from the front portion of the cargo carrier mortar, specifically, the body 3. As the tail is separating from the body 3, the split sleeves 15 and rear plate 12 fall away. The remaining contents disposed in the body 3, exit through the rear opening of the body 3.

Figure 5:
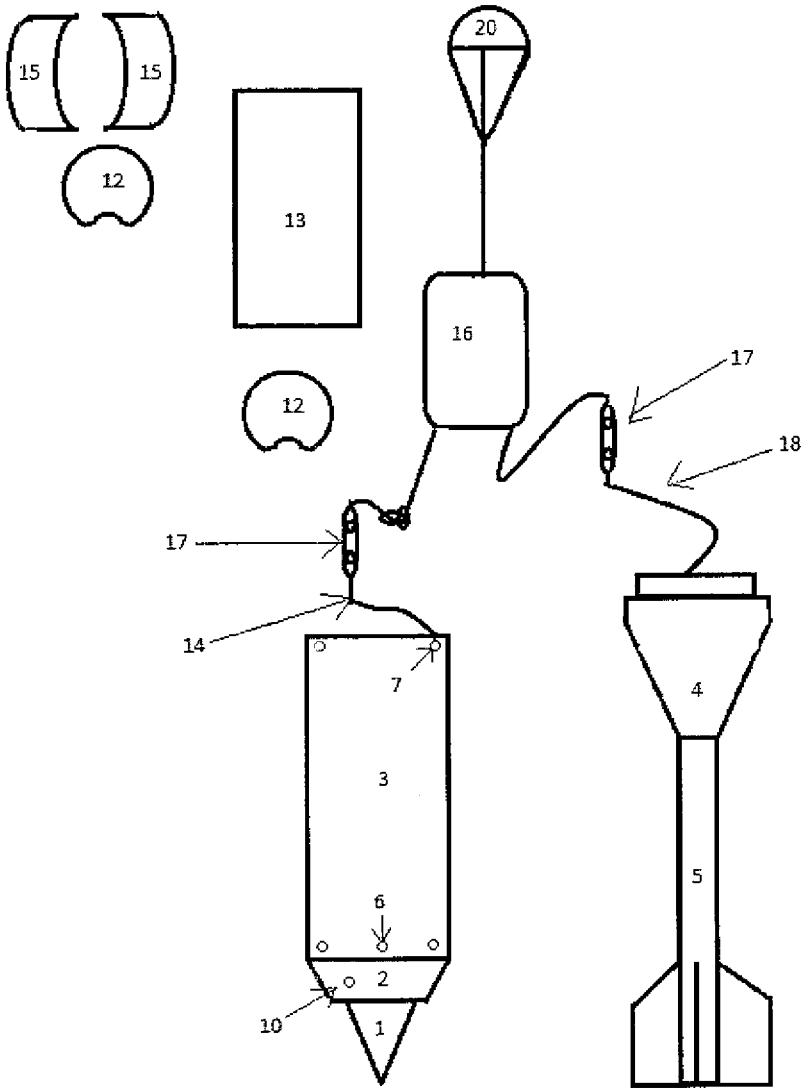
FIG. 5 is a diagram illustrating a non-lethal cargo carrier mortar at deployment, in accordance with an illustrative embodiment of the present invention.

FIG. 5 is a diagram illustrating a non-lethal cargo carrier mortar at deployment, in accordance with an illustrative embodiment of the present invention. As the contents of the cargo carrier mortar exit from the force of the supplemental charge 11, the drogue parachute assembly, including the first parachute 21 and the second parachute 22, are pulled out from the tail cone 4 as the tension increases on the first tether 14 and second tether 18. Once the drogue parachute 20 is in the wind stream, it opens and begins to pull the parachute bag 16 away from the first parachute 21 and the second parachute 22. The plates 12, split sleeves 15 and payload descend without a decelerator.

Figure 6:
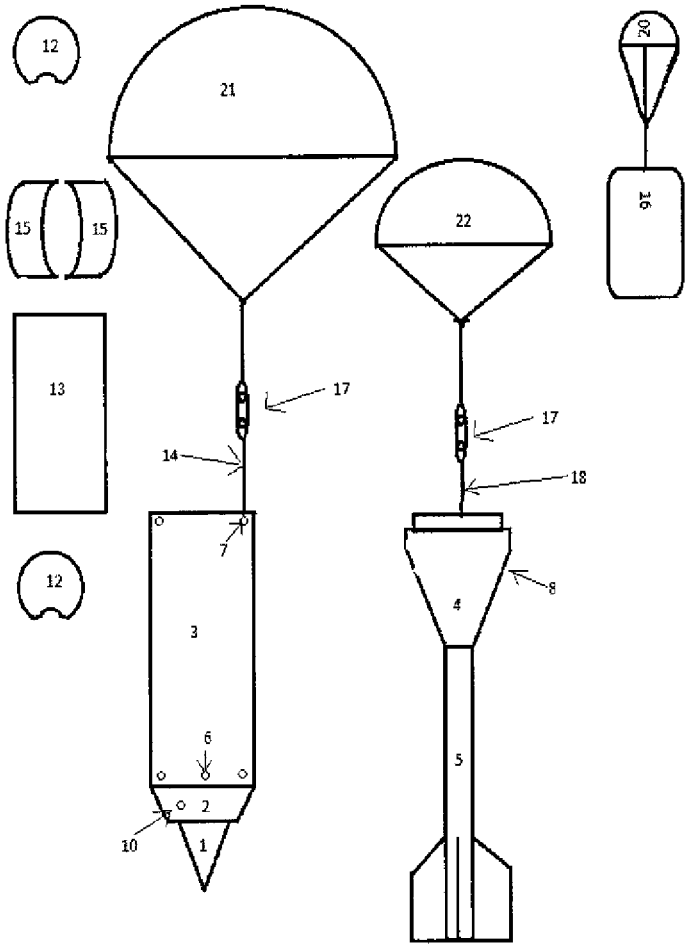
FIG. 6 is a diagram illustrating a non-lethal cargo carrier mortar at descent, in accordance with an illustrative embodiment of the present invention.

FIG. 6 is a diagram illustrating a non-lethal cargo carrier mortar at descent, in accordance with an illustrative embodiment of the present invention. After the parachute bag 16 is pulled away, the first parachute 21 and the second parachute 22 inflate and decelerate the front portion and rear portion of the cargo carrier mortar, respectively. The front portion and the rear portion descend at a predetermined velocity. The payload is delivered to the intended area.

Figure 7:
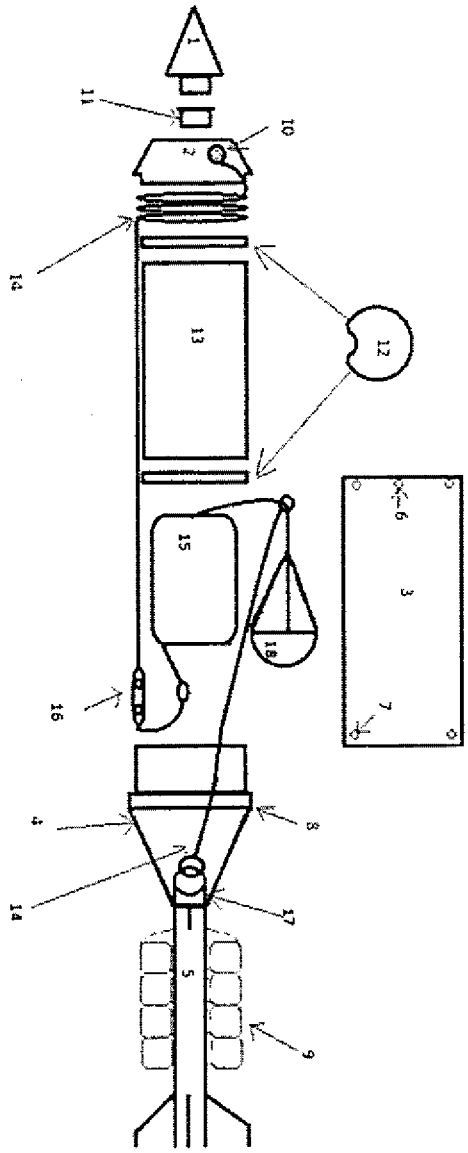
FIG. 7 is an exploded diagram illustrating the components of a non-lethal cargo carrier mortar, in accordance with an illustrative embodiment of the invention.

FIG. 7 is an exploded diagram illustrating the components of a non-lethal cargo carrier mortar, in accordance with an illustrative embodiment of the invention. In an embodiment of the invention, the non-lethal cargo carrier mortar may be from an indirect firing system of a smaller caliber, such as an M224 or M224A1 60 caliber mortar system. In such a caliber indirect mortar system, the smaller size and lighter weight of the cargo carrier mortar allows for the drogue parachute 20 to operate as the second parachute system in the deceleration system.

In this embodiment, the fuze 1, fuze adapter 2, body 3, tail and fin function similar to the previous embodiment. The fuze 1 is disposed in the front of the cargo carrier mortar and is configured for igniting a supplemental charge 11 at a predetermined time in the flight of the cargo carrier mortar. The fuze 1 may be a MTSQ M776 fuze currently employed by the United States Army. The fuze 1 is configured for igniting the supplemental charge 11 at a predetermined time or altitude in the mortar's flight based on ballistic equations to achieve a payload distance.

The fuze 1 and supplemental charge 11 are set in a fuze adapter 2. In addition to supporting the fuze 1 and supplemental charge 11, the fuze adapter 2 is configured for funneling the propulsive gases of the supplemental charge 11 toward the rear of the cargo carrier mortar and supporting a second tether 18 of a second parachute assembly, as will be described in further detail below. The fuze adapter 2 is connected to the body 3 of the cargo carrier mortar.

The body 3 of the cargo carrier mortar forms an inner cavity housing a first plate 12, a second plate 12, a payload area 13, a first parachute assembly, a second parachute assembly, a drogue parachute assembly, a first split sleeve 15 and a second split sleeve 15. The first plate 12 is configured for receiving the pressure built up from the fuze and supplemental charge and transferring it to the sub-munitions. The second plate 12 sits under the sub-munitions and receives the force from the front plate 12 and transfers the force to the front split sleeve 15 and second split sleeve 15. The front split sleeve 15 and the second split sleeve 15 surround the parachute assembly and transfer the force from the first plate 12 and second plate 12 to the tail cone thereby causing the shear pins to fail and the mortar carrier to separate.

One or more non-lethal sub-munitions are housed in the payload area 13. Advantageously, the payload area 13 provides an increased volume and payload potential due to the deceleration design reducing both the weight and volume of the deceleration system. In an embodiment of the invention, the payload area 13 houses fourteen (14) flash bang sub-munitions. While throughout this specification, the payload is described as one or more flash bang sub-munitions, the cargo carrier mortar is not limited to housing flash bang sub-munitions. In another embodiment, the payload area 13 may house.

The first split sleeve 15 and second split sleeve 15 are configured for protecting the parachute while also transferring force directly to the tail cone.

The first parachute assembly comprises a first parachute 21 connected to the front portion of the cargo carrier mortar via a first swivel and a first tether. The first parachute 21 is a parachute typically used in 60 mm Illumination mortar. The first parachute 21 is connected to the first swivel which is connected to the first tether 14. The first tether 14 attaches to the fuze adapter via a first fuze adapter pin 10. Prior to deployment, the first tether 14 is wrapped around the recessed surface of the fuze adapter 2. This recess surface shields the tether 14 from propulsive gases travelling from the fuze 1 of the cargo carrier mortar toward the body 3 of the cargo carrier mortar 1. Further, coiling the tether 14 within the recess of the fuze adapter 2 prevents tangling of the tether 14 and non-deployment of the first parachute 21.

The drogue parachute assembly comprises a drogue parachute 22 connected to the parachute bag. The parachute bag 15 is connected to the rear portion of the cargo carrier mortar via a swiveling eyebolt 17 and a second tether 18. The swiveling eyebolt 17 is connected to the fin assembly 5 of the cargo carrier mortar. The parachute bag 15 is then connected to the swiveling eyebolt 17 via a tether 18. In an embodiment of the invention, the drogue parachute 21 is a parachute of a size and dimension larger than those typically used for other sixty millimeter mortar rounds.

At fuze detonation, the fuze 1 detonates a supplemental charge 11 causing the front of the round to pressurize. If required, the supplemental charge 11 may also ignite the payload. The pressure from the supplemental charge 11 provides a force on the contents within the body 3 toward the rear of the cargo carrier mortar. Once enough force is applied to the tail cone 4, the shear pins 7 fail which allows the rear portion of the cargo carrier mortar, specifically the tail, to separate from the front portion of the cargo carrier mortar, specifically, the body 3. As the tail is separating from the body 3, the split sleeves 15 and rear plate 12 fall away. The remaining contents disposed in the body 3, exit through the rear opening of the body 3.

As the contents of the cargo carrier mortar exit from the force of the supplemental charge 11, the drogue parachute assembly, including the first parachute 22, are pulled out from the tail cone 4 as the tension increases on the first tether 14 and second tether 18. Once the drogue parachute 20 is in the wind stream, it opens and begins to pull the parachute bag 16 away from the first parachute 22. The plates 12, split sleeves 15 and payload descend without a decelerator.

After the parachute bag 16 is pulled away, the first parachute 22 inflates and decelerates the rear portion of the cargo carrier mortar. The drogue parachute decelerates the front portion of the cargo carrier mortar. The front portion and the rear portion descend at a predetermined velocity. The payload is delivered to the intended area.

We claim:

1. A non-lethal cargo carrier mortar configured for delivering a non-lethal payload and descending at a non-free fall velocity, the non-lethal cargo carrier mortar comprising:

a first parachute assembly comprising a first tether coupling a first parachute to a front portion of the non-lethal cargo carrier mortar;

wherein the front portion comprises a fuze, a fuze adapter and a body;

a second parachute assembly comprising a second tether coupling a second parachute to a rear portion of the non-lethal cargo carrier mortar;

wherein the rear portion comprises a tail cone and a fin; and a recess formed within the front portion of the non-lethal cargo carrier mortar, the recess configured for supporting the first tether on an outer conical surface of the fuze adapter and further configured for shielding the tether from gases ejected from a supplemental charge ignited by a fuze.

2. The non-lethal cargo carrier mortar of claim 1 wherein the recess is formed within the fuze adapter.

3. The non-lethal cargo carrier mortar of claim 2 wherein the first tether is coupled to the fuze adapter.

4. The non-lethal cargo carrier mortar of claim 3 wherein the fuze adapter further comprises a steel alloy pin extending from a surface of the fuze adapter and wherein the first tether is looped around the steel alloy pin.

5. The non-lethal cargo carrier mortar of claim 1 wherein the first tether and the second tether are composed of one of the following materials: Technora, Kevlar and steel.

6. The non-lethal cargo carrier mortar of claim 1 wherein the first tether and the second tether are wrapped in a low friction tape configured for preventing abrasion.

7. The non-lethal cargo carrier mortar of claim 1 wherein the second tether is coupled to an eyebolt of the tail cone.

8. The non-lethal cargo carrier mortar of claim 1 wherein both the first parachute and the second parachute are disposed in a common drogue parachute assembly.

9. The non-lethal cargo carrier mortar of claim 1 wherein the first tether is coiled around the recess to maximize a payload area within the body.

10. The non-lethal cargo carrier mortar of claim 1 wherein a payload area formed by a body of the front portion is configured for housing flash bang munitions.

11. An 81 millimeter caliber non-lethal cargo carrier mortar configured for delivering a non-lethal payload and descending at a non-free fall velocity, the non-lethal cargo carrier mortar comprising:

an M776 fuze configured for detonating a supplemental charge at a predetermined time;

a fuze adapter configured for supporting the M776 fuze and further comprising a recess formed within an outer surface of the fuze adapter, the recess configured for supporting a first tether coiled on an outer surface of the recess and shielding the first tether by channeling propulsive gases released from the supplemental charge through an inner surface of the recess;

a body comprising a payload area formed in a cavity of the body and one or more shear pins configured for shearing in response to pressure from the propulsive gases;

a tail cone;

a fin;

a first parachute assembly comprising the first tether coupling a first parachute disposed in the payload area of the body to the fuze adapter;

a second parachute assembly comprising a second tether coupling a second parachute disposed in the payload area of the body to the tail cone; and a drogue parachute assembly comprising a drogue parachute and a parachute bag configured for housing the first parachute and second parachute until deployment.

12. The non-lethal cargo carrier mortar of claim 11 wherein the payload area is configured for holding fourteen flash bang munitions.

13. The non-lethal cargo carrier mortar of claim 11 wherein the payload area has a length dimension of 6.625 inches.

14. The non-lethal cargo carrier mortar of claim 11 wherein the first tether and the second tether are composed of one of the following materials: Technora, Kevlar and steel.

15. The non-lethal cargo carrier mortar of claim 11 wherein the first tether and the second tether are wrapped in a low friction tape configured for preventing abrasion.

16. The non-lethal cargo carrier mortar of claim 11 wherein the fuze adapter further comprises a steel alloy pin extending from a surface of the fuze adapter and wherein the first tether is looped around the steel alloy pin.

* * * * *